US005222452A

United States Patent [19]

Maloney et al.

[11] Patent Number: 5,222,452

[45] Date of Patent: Jun. 29, 1993

[54] BOAT HULL CLEANING APPARATUS

[76] Inventors: Michael J. Maloney, 6621 Island Rd., Cicero, N.Y. 13039; Ronald C. Pennock, 5424 Orangeport Rd., Brewerton, N.Y. 13029

[21] Appl. No.: 898,498

[22] Filed: Jun. 15, 1992

[51] Int. Cl.[5] ..... B60S 3/00

[52] U.S. Cl. ..... 114/222

[58] Field of Search ..... 114/222, 343, 230

[56] References Cited

U.S. PATENT DOCUMENTS

| | | | |
|---|---|---|---|
| 3,443,545 | 5/1969 | Vadseth | 114/222 |
| 3,709,184 | 1/1973 | Laney | 114/222 |
| 3,863,393 | 2/1975 | Goff | 114/222 |
| 3,906,572 | 9/1975 | Winn | 15/1.7 |
| 3,946,692 | 3/1976 | Sierra et al. | 114/222 |
| 4,043,286 | 8/1977 | Dots | 114/222 |
| 4,084,535 | 4/1978 | Rees | 114/222 |
| 4,102,290 | 7/1978 | Weiss | 114/222 |
| 4,236,477 | 12/1980 | Norris et al. | 114/222 |
| 4,337,716 | 7/1982 | Harris | 114/222 |
| 4,395,966 | 8/1983 | Murphy | 114/222 |
| 4,619,217 | 10/1986 | Wachi | 114/222 |
| 4,734,954 | 4/1988 | Greskovics et al. | 15/1.7 |
| 4,838,193 | 6/1989 | Van Der Tak | 114/222 |
| 4,843,995 | 7/1989 | Bingham | 114/222 |
| 4,926,775 | 5/1990 | Andorsen | 114/222 |
| 4,932,349 | 6/1990 | Gohon | 114/222 |

*Primary Examiner*—Joseph F. Peters, Jr.
*Assistant Examiner*—Stephen P. Avila
*Attorney, Agent, or Firm*—Lawrence P. Trapani

[57] ABSTRACT

The apparatus includes a support mechanism for supporting the cleaning apparatus in the body of water, a hull cleaning assembly including a plurality of brush assemblies, and a mechanism for moving the brush assemblies between hull cleaning positions and hull clearing positions. The brush assemblies each have a buoyancy element, a motor supported by the buoyancy element, and a cleaning brush coupled to a drive shaft of the motor. The buoyancy elements of the brush assemblies are hinged together to constitute a unified hull cleaning assembly. The moving mechanism includes a control device for controlling the movement of the brush assemblies. In addition, the moving mechanism includes a plurality of control lines movably engaging the support mechanism. The control lines are connected to the brush assemblies respectively at one end and to the control device at the other end. The support mechanism includes a pulley arrangement rotatably secured therein. The control lines movably engage the support mechanism through the pulley arrangement. Methods are also contemplated by the present invention. These methods comprise the steps of (1) supporting the cleaning apparatus in the body of water; (2) maneuvering the boat hull over the brush assemblies; (3) floating the brush assemblies to a cleaning position around a bottom portion of the boat hull by employing the buoyancy elements of the brush assemblies; and (4) actuating the cleaning brushes of the brush assemblies into a cleaning action by driving the motors of the brush assemblies.

20 Claims, 4 Drawing Sheets

BOAT HULL CLEANING APPARATUS

BACKGROUND OF THE INVENTION

1. Technical Field

The present invention relates generally to boat cleaning apparatus, and more particularly to apparatus for automatically cleaning the bottom portion of a boat hull floating in a body of water.

2. Background Art

Within the scope of the present invention, there is contemplated an apparatus, having rotating cleaning brushes, for automatically cleaning the bottom portion of a boat hull. In conventional boat cleaning apparatus, it is typical to experience cleaning devices having rotating brushes that are manipulated manually over the hull of the boat. In order to clean the bottom portion of the hull with such devices, the operator must either dive to the hull bottom or manipulate an elaborate device that can reach the hull bottom. An example of the former case is disclosed in U.S. Pat. No. 4,084,535 to Rees, and of the latter in U.S. Pat. No. 4,102,290 to Weiss. These arrangements have a substantial drawback in that they are difficult to maneuver over the bottom portion of the hull and clean only a small area of the hull at a time.

One attempt to overcome the problems associated with the above-described devices, was the development of a manual scrubbing belt described in U.S. Pat. No. 4,395,966 to Murphy. However, such belts suffer from the disadvantage that they must be manually drawn back and forth across the hull's undersurface. This device requires two operators, one situated on each side of the boat to be cleaned. Thus, the device can only be used where two operator platforms are available.

Approaches to automatic boat cleaning berths for cleaning the entire hull bottom have been proposed, for example, in U.S. Pat. No. 4,236,477 to Norris et al. and U.S. Pat. No. 4,102,290 to Weiss. However, these approaches suffer from drawbacks in that they require: (a) a framework on both the port and starboard sides of the berth; (b) an elaborate arrangement of supporting members for the cleaning brushes; (c) a complex array of hydraulic or pneumatic driving elements for positioning the brushes between cleaning and non-cleaning stations; and (d) numerous adjustments of the supporting members to position the brushes about the hull for cleaning. Such complicated systems are expensive, and difficult to operate and maintain.

Further, such systems are not sufficiently adaptable to be installed at a variety sites having different configurations. For example, in the patent to Norris et al., the device must rest on the floor of a body of water or be tied to pilings situated on each side of the device's framework. In the patent to Weiss, the device must be mounted to two closely spaced apart docks.

SUMMARY OF THE INVENTION

It is therefore an object of the present invention to provide an automatic boat hull cleaning apparatus that avoids the problems associated with the prior art.

It is another object of the present invention to provide an automatic boat hull cleaning apparatus that is simple to maneuver into position for cleaning the bottom portion of a boat hull.

It is a further object of the present invention to provide an automatic boat hull cleaning apparatus that can be operated by one individual stationed on a single platform.

It is yet another object of the present invention to provide an automatic boat hull cleaning apparatus that does not require its operator to enter the water during a normal hull cleaning procedure.

It is yet a further object of the present invention to provide an automatic boat hull cleaning apparatus that cleans a sizable area of the hull bottom at one time.

It is still another object of the present invention to provide an automatic boat hull cleaning apparatus having a reduced framework and simplified assembly of moving parts for improved reliability and reduced manufacturing and maintenance costs.

It is still a further object of the present invention to provide an automatic boat hull cleaning apparatus having a versatile framework that can be installed at a variety of differently configured sites.

It is indeed another object of the present invention to provide an automatic boat hull cleaning apparatus having a cleaning assembly that self-positions about the boat hull without the use of hydraulic, pneumatic or other active drive elements.

These and other objects are attained in accordance with the present invention wherein there is provided an apparatus for cleaning a boat hull floating in a body of water. The apparatus comprises: a support means for supporting the cleaning apparatus in the body of water, a hull cleaning assembly including a brush assembly, and a mechanism for moving the brush assembly between a hull cleaning position and a hull clearing position. The brush assembly has a buoyancy element, a motor supported by the buoyancy element, and a cleaning brush coupled to a drive shaft of the motor. A power line, connected to the motor, conveys operating power from a power source to the motor. The moving mechanism is operably connected to the brush assembly and to the support means.

In the preferred embodiment, the hull cleaning assembly comprises a plurality of brush assemblies each having a buoyancy element, a motor supported by said buoyancy element, and a cleaning brush coupled to a drive shaft of the motor. In this embodiment, the moving mechanism is connected to the support means and to each of the plurality of brush assemblies for moving the brush assemblies between respective hull cleaning positions and respective hull clearing positions. In the preferred embodiment, the buoyancy elements of the brush assemblies are hinged together to constitute a unified hull cleaning assembly.

The moving mechanism may include a control device for controlling the movement of the brush assemblies between respective hull cleaning and hull clearing positions. In addition, the moving mechanism may include a plurality of control lines movably engaging the support means. In such an embodiment, the control lines are connected to the brush assemblies respectively at one end and to the control device at the other end. The support means may include a support member, and a pulley arrangement rotatably secured to the support member. In this embodiment, the control lines movably engage the support member through the pulley arrangement.

In the preferred embodiment, the buoyancy element of each brush assembly includes a shell having a wall that defines an interior volume and an opening. The wall contains an exterior recess in which the motor of the brush assembly is installed. In addition, the buoyancy element includes a plate which is attached to the shell, over the opening, such that the shell is enclosed. The drive shaft of the motor extends through a hole in the exterior recess and through a hole in the plate; and the motor is fixedly mounted to the plate. The interior volume of the enclose shell contains a buoyancy material, such as polystyrene.

Methods for cleaning a boat hull floating in a body of water are also contemplated by the present invention. These methods generally comprise the steps of (1) supporting the cleaning apparatus in the body of water; (2) maneuvering the boat hull over the brush assemblies; (3) floating the brush assemblies to a cleaning position around a bottom portion of the boat hull by employing the buoyancy elements of the brush assemblies; and (4) actuating the cleaning brushes of the brush assemblies into a cleaning action by driving the motors of the brush assemblies.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENTS

Figure 1:
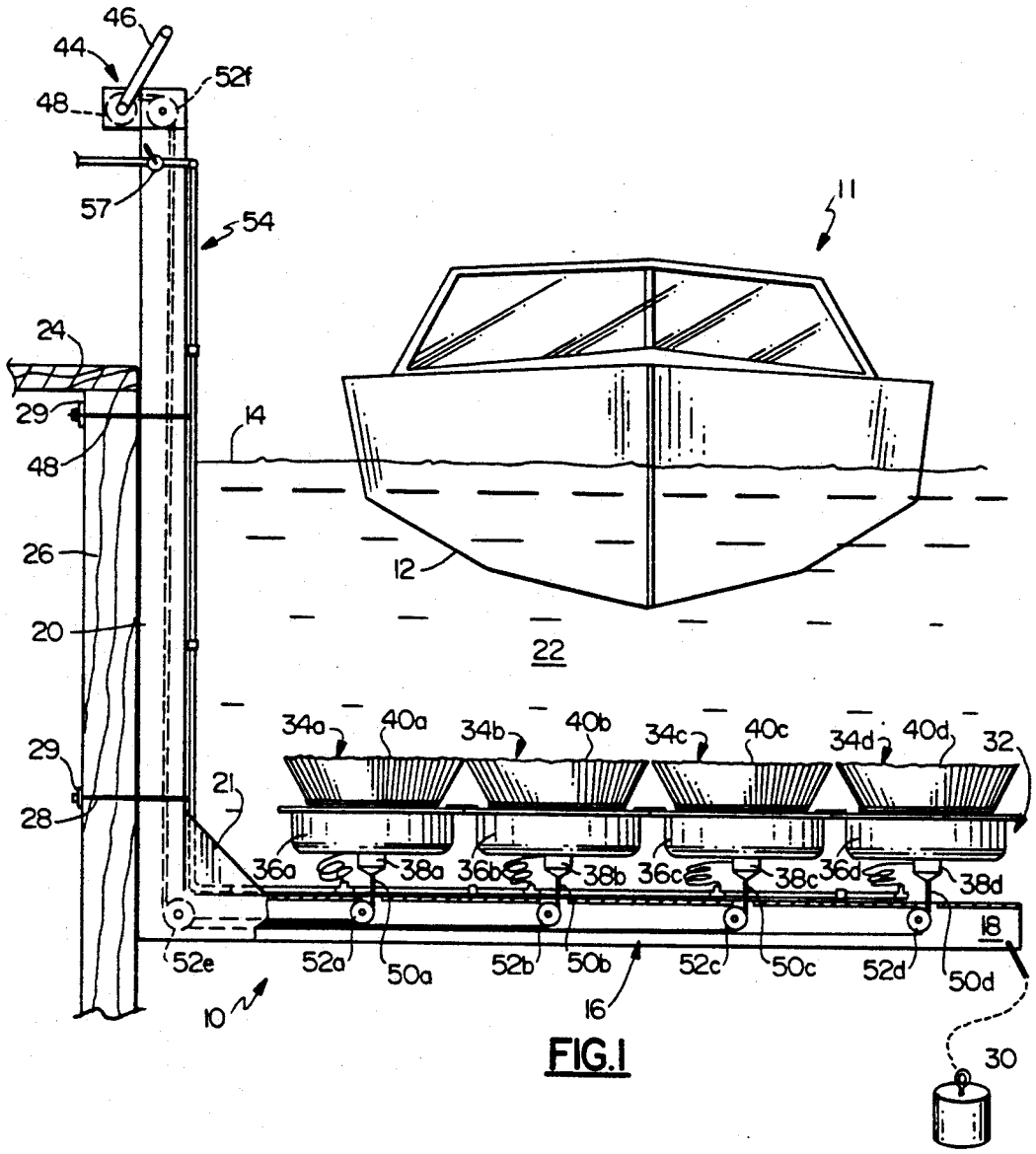
FIG. 1 is an elevation view of a boat hull cleaning apparatus embodying the teachings of the present invention, shown in a hull clearing position with a boat present.

Referring to FIG. 1 of the drawings, there is shown an elevation view of a boat hull cleaning apparatus 10 embodying the teachings of the present invention. Cleaning apparatus 10 is positioned, configured and dimensioned for cleaning relatively small sized boats, such as pleasure craft and other boats considered in the "small craft" class. As shown in FIG. 1, a boat 11, having a boat hull 12, is afloat in a body of water 14 adjacent to cleaning apparatus 10. Cleaning apparatus 10 is particularly configured for cleaning the bottom portion of hull 12 (See also FIG. 3).

As shown in FIG. 1, cleaning apparatus 10 comprises a support structure 16 having a support arm 18 and a mounting arm 20. Support arm 18 and mounting arm 20 are welded together and braced by a gusset 21. Support structure 16 is secured in a berth 22 which is adjacent to a dock 24. The term "berth", as used in this specification, means enough space in water 14 for a boat to maneuver. In the particular example shown in FIG. 1, support 16 is mounted to a dock post 26 by a pair of galvanized, stainless steel, U-bolts 28 and steel bars 29 threaded thereon. Support structure 16 is further stabilized by an anchor 30 tied to support arm 18 by a steel cable, as shown in FIG. 1.

As shown in FIG. 1, support 16 is positioned in berth 22 such that support arm 18 is under hull 12 and oriented crosswise thereto (i.e., from starboard to port). In the embodiment shown in FIG. 1, support 16 is suspended in berth 22, off the floor of the body of water. However, depending upon the particular installation of cleaning apparatus 10, support 16 could also be placed on the floor of the body of water (See FIG. 9). The construction of support 16 is described hereinbelow with respect to FIG. 4.

With further reference to FIG. 1, cleaning apparatus 10 further comprises a cleaning assembly 32 having four brush assemblies 34*a–d*. Brush assemblies 34*a–d* include buoyancy elements 36*a–d* for providing buoyancy to brush assemblies 34*a–d* respectively; motors 38*a–d* supported by buoyancy elements 36*a–d* respectively; and circular cleaning brushes 40*a–d* mounted to drive shafts of motors 38*a–d* respectively (See FIG. 5). Brush assemblies 34*a–d* are hinged together at adjoining side edges by hinges 42*a–c* to produce a unified hull cleaning assembly 32 (See FIG. 2). Preferably, hinges 42*a–c* are flexible strips of resilient material, such as a plied rubber transmission belt material (e.g., Model 3 Ply CN40 Tan FS×FS, manufactured by Beltservice Corporation, Earth City, Mo.). Such material is constructed of cotton and nylon fabric plies bounded with resilient rubber compounding. Assembly of brush assemblies 34*a–d* and the construction of buoyancy elements 36*a–d* will be described hereinbelow with reference to FIGS. 5 and 6.

Figure 2:
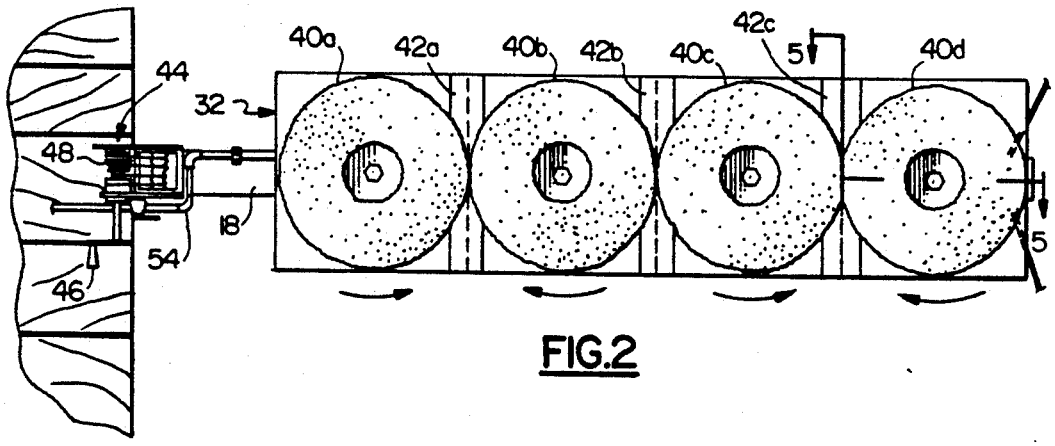
FIG. 2 is an top plan view of the boat hull cleaning apparatus of FIG. 1, without the boat present.
Figure 3:
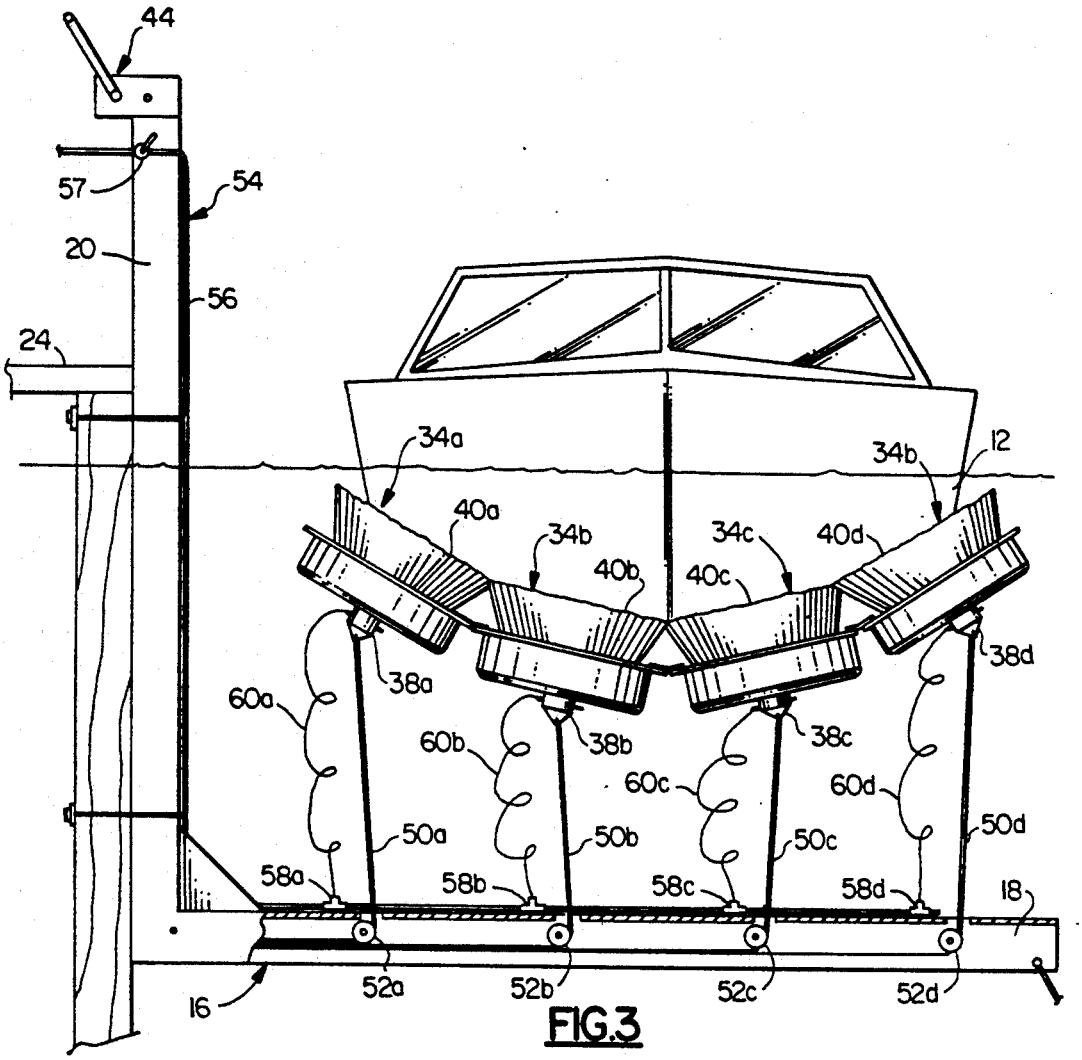
FIG. 3 is an elevation view of the boat hull cleaning apparatus of FIG. 1, shown in a hull cleaning position with the boat present.

In cleaning apparatus 10, means is provided for moving brush assemblies 34*a–d* between respective hull clearing positions, as shown in FIG. 1, and respective hull cleaning positions, as shown in FIG. 3. Such means includes a control system for controlling the movement of brush assemblies 34*a–d* between respective hull clearing and respective hull cleaning positions. In the preferred embodiment, and as shown in FIGS. 1 and 2, the control system is a winch 44 mounted to mounting arm 20 of support 16. Winch 44 includes a crank 46, a system of spools 48*a–d*, and a ratchet mechanism 49 associated with crank 46 and spools 48 (See FIG. 7).

The moving means also includes four control lines 50*a–d* movably engaging support 16 through a system of pulley wheels 52*a–f*, as shown in FIG. 1. Control lines 50*a–d* run from their respective pulley wheels 52*a–d* to pulley wheel 52*e*, as most clearly shown in FIG. 4. From pulley wheel 52*e*, control lines 50*a–d* run through the interior of mounting arm 20, along its central axis, to pulley wheel 52*f* (See FIGS. 1 and 4). From pulley wheel 52*f*, control lines 50*a–d* extend and are connected to winch spools 48*a–d* (See FIG. 7). At their other ends, control lines 50*a–d* are connected to motors 38*a–d* respectively, as schematically represented in FIG. 1. Preferably, control lines 50*a–d* are 3/16 to ¼ inch steel braided cable or "Aircraft Control Cable".

As schematically represented in FIGS. 1, pulley wheels 52*a–f* are rotatably mounted in support 16. The function of pulley wheels 52*a–f* is to change the direction and point of application of pulling forces, generated by winch 44 and brush assemblies 34*a–d*, across control lines 50*a–d*.

Figure 7:
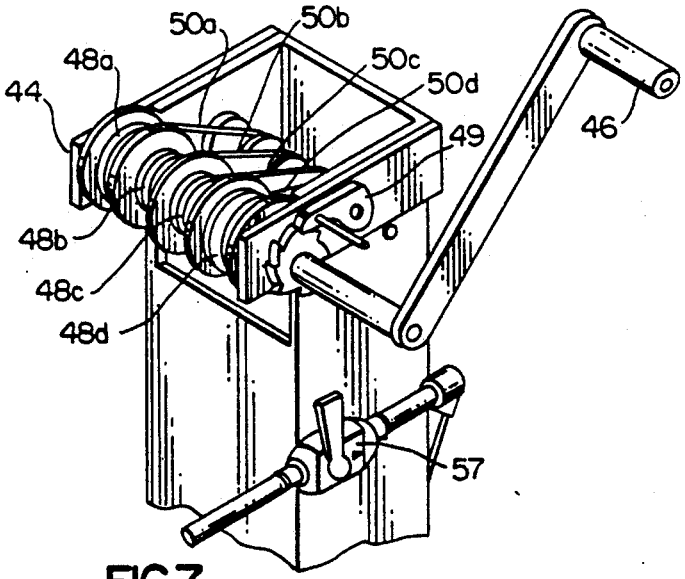
FIG. 7 is an enlarged perspective view of a winch employed as a control mechanism in the boat hull cleaning apparatus of the present invention.

Referring to FIG. 7, there is shown an enlarged perspective view of winch 44 as constructed in accordance with the preferred embodiment of the present invention. In operation, control lines 50*a–d* are simultaneously wound around or unwound from spools 48*a–d* depending upon the direction of rotation of crank 46. As shown in FIG. 3, lines 50*a* and 50*d* must extend a greater distance from support arm 18 than lines 50*b* and 50*c*, to permit brush assemblies 34*a* and 34*d* to reach the upwardly sloping portions of boat hull 12. To compensate for this, spools 48*a* and 48*d* are made with larger diameters than spools 48*b* and 48*c*. Thus, control lines 50*a* and 50*d* can be taken up or let out to a greater extent than control lines 50*b* and 50*c* for each turn of crank 46. In FIG. 7, the diameters of spools 48*a* and 48*d* are the same, and the diameters of spools 48*b* and 48*c* are the same. Ratchet 49, with its wheel and pawl arrangement, functions to control the movement of control lines 50*a–d*, through support structure 16, in incremental steps. When engaged, ratchet 49 retains the resulting incremental positions of brush assemblies 34*a–d*. For instance, ratchet 49 retains brush assemblies 34*a–d* in a hull clearing position in FIG. 1 and in a hull cleaning position in FIG. 3.

The hull clearing position shown in FIG. 1 is removed from the bottom portion of hull 12 such that brushes 40*a–d* are out of contact with hull 12. However, it is not necessary that brushes 40*a–d* be entirely removed from hull 12 when in a hull clearing position. It is enough that brushes 40*a–d* be positioned to allow boat 11 to maneuver in or out of berth 22 unencumbered. A hull cleaning position, on the other hand, is adjacent to the bottom portion of hull 12 such that brushes 40*a–d* are urged up against hull 12, as shown in FIG. 3.

Cleaning apparatus 10 further comprises power conveying means 54 for conveying operating power to motors 38*a–d*, as schematically represented in FIGS. 1–3. As shown in FIG. 3, power conveying means 54 includes a conduit 56, mounted to support 16, running from a power supply (not shown) on dock 24 to support arm 18. Along support arm 18, conduit 56 contains four in-line couplers 58*a–d* spaced apart along arm 18, as shown in FIG. 3. Four power lines 60*a–d* are connected at one end to couplers 58*a–d* respectively and at the other end to motors 38*a–d* respectively. Power conveying means 54 may be any type of power conveying system suitable for the environment in which cleaning apparatus 10 will operate. For example, power conveying means 54 may be an pneumatic, hydraulic or electric system. In this regard, motors 38*a–d* may be any type of motor that can operate submerged in water, such as a pneumatic (or air-powered) motor, a hydraulic motor, or an electric motor. In the preferred embodiment, motors 38*a–d* are air-powered motors. Motors 38*a–d* are powered by a pneumatic power supply, including an air compressor and a regulator (not shown). Conduit 56 is an air supply pipe having an adjustable in-line air valve 57. Power lines 60*a–d* are flexible, coiled, pneumatic supply hoses.

Figure 4:
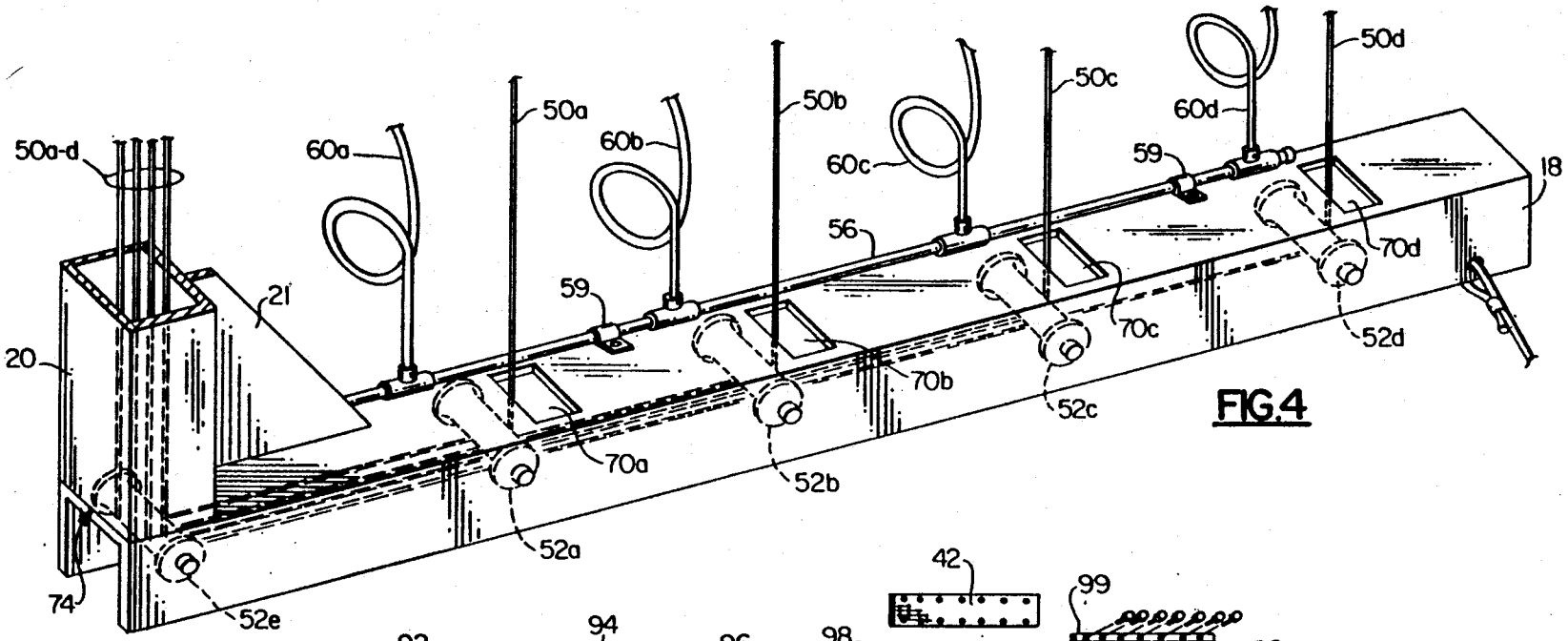
FIG. 4 is an enlarged perspective view of a selected portion of a support mechanism employed in the boat hull cleaning apparatus of FIG. 1.

With reference to FIG. 4, the construction of support 16 can be understood. Support arm 18 is a dual-sided channel iron of approximately 8 feet long, made of steel or aluminum. Mounting arm 20 is an enclosed channel made from two steel or aluminum channel irons welded together, also approximately 8 feet long. Support arm 18 and mounting arm 20 are welded together at a joint 74, and gusset 21 is welded to support arm 18 and mounting arm 20 at joint 74. Openings 70*a–d* are produced in support arm 18 by a drilling, cutting or stamping process. Hole pairs are drilled in opposing side walls of both support arm 18 and mounting arm 20 to receive and support the axles of pulley wheels 52*a–f*. As shown in FIG. 4, conduit 56 is secured to support 16 by regularly spaced clips 59 which are riveted or screw-fastened to support 16. An additional hole is drilled in one side wall of support arm 18 for securing the cable of anchor 30 to support arm 18.

Figure 5:
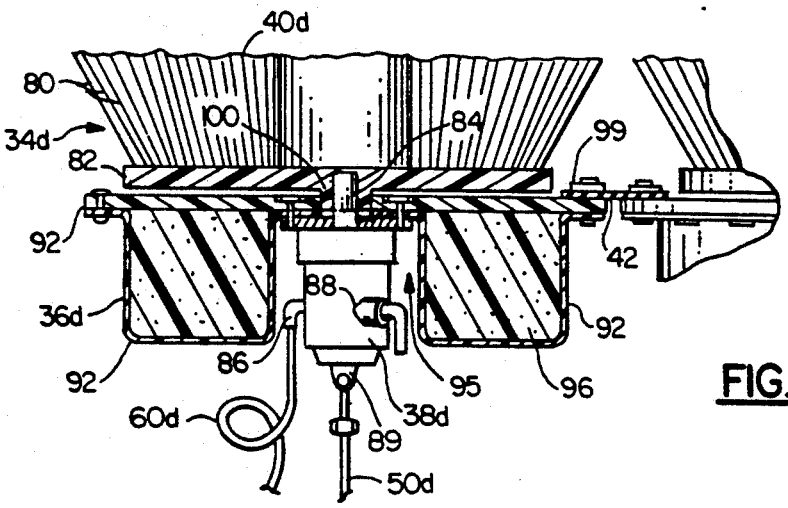
FIG. 5 is a sectional view of a brush assembly of the boat hull cleaning apparatus, taken along the line 5—5 in FIG. 2.
Figure 6:
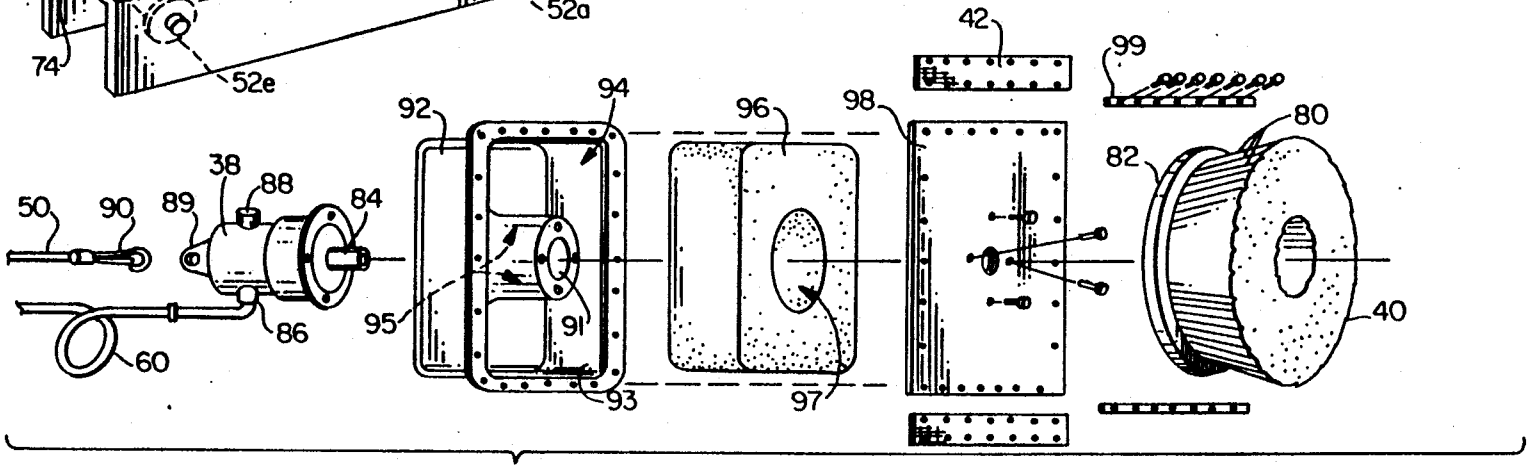
FIG. 6 is an exploded view of a brush assembly of the boat hull cleaning apparatus, showing its construction in accordance with the present invention.

With reference to FIGS. 5 and 6, the construction of brush assemblies 34*a–d* can be understood. FIG. 5 is a sectional view taken along the line 5—5 in FIG. 4. In FIG. 5, circular brush 40*d* is shown. Brushes 40*a–d* are identical; therefore, a description of brush 40*d* will be applicable to all brushes in cleaning assembly 32. Brush 40*d* may be a hub cap brush, the type used in automatic car washes, manufactured by Erie Brush & Manufacturing, Chicago, Ill. As shown in FIG. 5, brush 40*d* has a multiplicity of non-abrasive cleaning bristles or filaments 80 projecting from a circular disc 82. Circular disc 82 may be made of, for example, wood, plastics or hard rubber.

With further reference to FIG. 5, there is shown motor 38*d* containing an air inlet port 86 and an air exhaust port 88. Power line 60*d* contains a threaded male coupling (not shown) which mates with threads on the inside wall of inlet port 86. Air under pressure is supplied through inlet port 86 from power line 60*d* to actuating vanes inside motor 38*d*, in a conventional manner. The resulting air discharge is exhausted into water 14 through exhaust port 88. Contained inside motor 38*d*, in-line with exhaust port 88, is a spring-loaded check valve (not shown) which permits the air exhaust to be discharged into water 14, and prevents entry of water into motor 38*d* when the air pressure is removed. Alternatively, a return hose can be threaded to exhaust port 88 for carrying the exhausted air to an exhaust manifold which, in turn, would be connected to an exhaust muffler.

As shown in FIG. 5, the rear portion of motor 38*d* is outfitted with a coupling ring 89. Control line 50*d* is connected to coupling ring 89 by use of a safety latch hook 90, as clearly shown in FIG. 6. Preferably, motor 38 is a 1 ½ horsepower air motor, that can be completely reversed in rotation, and operated in any plane. In addition, motor 38*d* should have a variable speed capability and contain 8 actuating vanes. As an example, motor 38*d* may be the Model 4AM-NRV-70C, manufactured by Gast Manufacturing Corporation of Benton Harbor, Mich., modified for slow rotation rates (20–50 rpm) and outfitted with a coupling ring.

The construction of buoyancy elements 36*a–d* can be understood by inspection of FIGS. 5 and 6. As shown in FIG. 6, buoyancy element 36*d* comprises a fiberglass shell 92 having an encasing wall 93. Wall 93 defines an interior volume 94 and an opened side (See FIG. 6). Wall 93 contains an exterior recess 95 in which motor 38 is to be installed during assembly. Buoyancy element 36*d* also comprises a buoyancy billet 96, containing a bore 97 therethrough to accommodate recess 95 (See FIG. 6). In assembly, billet 96 is closely fitted into shell 92 to occupy interior volume 94. Billet 96 is preferably made of a polystyrene plastic material. For example, a STYROFOAM brand buoyancy billet, manufactured by The Dow Chemical Company of Midland, Mich., is a suitable material.

Buoyancy element 36 further comprises a fiberglass mounting plate 98 attached to shell 92 by a fiberglass adhesive compound or, as shown in FIGS. 5 and 6, by a number of bolts. In the latter case, a sealing compound is used at the fastening points to ensure that water does not penetrate the completed assembly of buoyancy element 36. The bolts, used along the sides of plate 98 which adjoin other brush assemblies, are also used to fasten hinge 42 to plate 98. As shown in FIGS. 5 and 6, mounting strips 99 are used to provide strength and durability to the hinge assembly.

As shown in FIG. 6, motor 38 is installed in recess 95, and drive shaft 84 is passed through a hole 91 contained in recess 95. Motor 38 is mounted to shell 92 and mounting plate 98 with four mounting bolts. In assembly, four mounting holes contained in each of plate 98, recess 95 and motor 38 are aligned, and the mounting bolts are passed through and clamped with threaded nuts (not shown). A sealing compound may also be used on the areas where shell 92 and plate 98 make contact when assembled. When assembled, drive shaft 84 of motor 38 extends through plate 98. Brush 40 is mounted to the extending portion of shaft 84. A collar 100 (See FIG. 5), concentrically located on the back of disc 82, is slipped over shaft 84 and fixed thereto by a set screw (not shown) radially threaded through collar 100.

Figure 9:
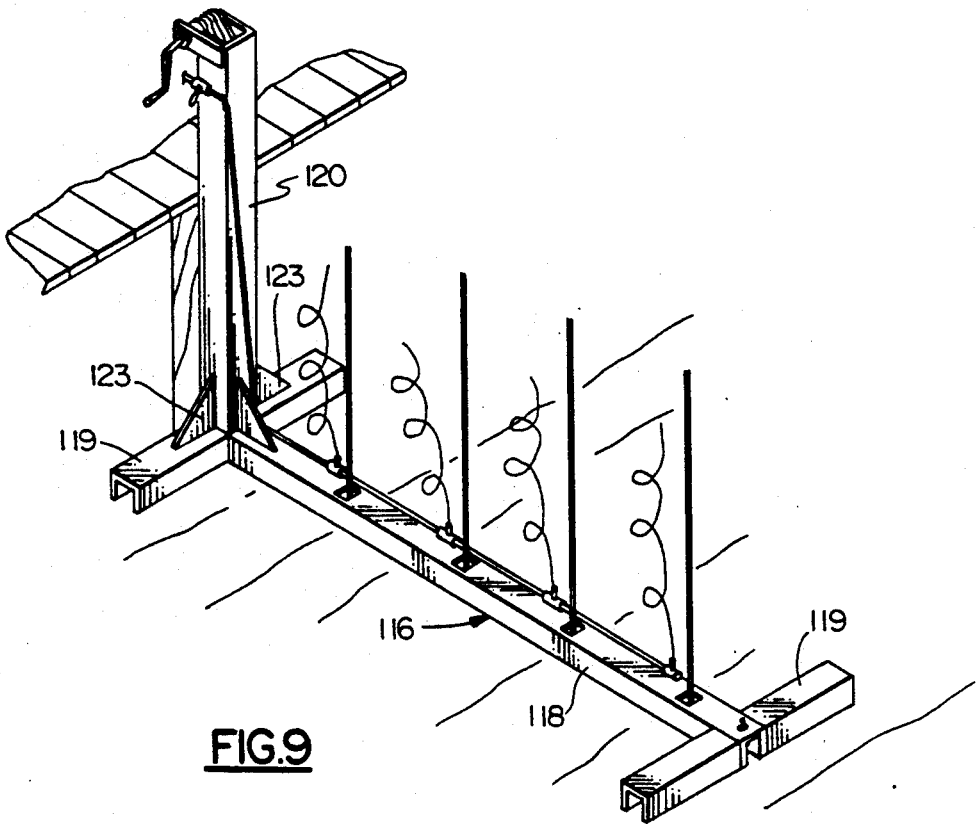
FIG. 9 is a perspective view of an alternative embodiment of the support mechanism employed in the boat hull cleaning apparatus of the present invention.

With reference to FIG. 9, there is shown an alternative embodiment of the support structure, designated by the reference numeral 116. Support 116 is intended to be positioned on the floor of a body of water. Support 116 includes a support arm 118 and a mounting arm 120, as with the first embodiment shown in FIG. 1. In the alternative embodiment, support 116 includes two out riggers 119 for stabilizing support 116 during operation of the cleaning apparatus. Two gussets 123, in addition to a gusset 121, are provided between arm 120 and the adjacent outrigger 119.

It should be noted that the present invention is not limited to the installations shown in FIGS. 1 and 9. Cleaning apparatus 10 may be adapted for any conceivable site configuration presented by such structures as docks, boats, trailers or bottom surfaces.

In the preferred operation, brush assemblies 34*a–d* are initially set in a hull clearing position by simultaneous adjustment of control lines 50*a–d* with winch 44. Boat 11, the boat to be cleaned, is then maneuvered into berth 22, positioned over cleaning assembly 32, and oriented such that cleaning assembly 32 runs from starboard to port, as shown in FIG. 1. Boat 11 is readied for cleaning by positioning its stern directly over brush assemblies 34*a–d*. Winch 44 is then operated to unwind control lines 50*a–d*, causing brush assemblies 34*a–d* to rise as a result of buoyancy elements 36*a–d*. Control lines 50*a–d* are unwound until brush assemblies 34*a–d* position themselves around the bottom portion of hull 12, at the stern, in a hull cleaning position, as shown in FIG. 3. It is noted that brush assemblies 34*a–d* are caused to self-position around the bottom of hull 12 by the buoyancy action of buoyancy elements 36*a–d*, and not by use of any active drive elements.

Ratchet 49 is engaged to ensure that brush assemblies 34*a–d* are retained in the cleaning position during the cleaning operation. In the cleaning position, brushes 40*a–d* are urged against hull 12 with a pressure of about 25 pounds per square inch. Once the brush assemblies 34*a–d* are fixed in the cleaning position, the pneumatic power supply is activated to drive motors 38*a–d* and cause brushes 40*a–d* to rotate. The rotation rate of brushes 40*a–d* is adjustable from the pneumatic regulator and/or air valve 57. The optimum rotation rate of brushes 40*a–d* for cleaning the hull bottom is between 20 and 50 rpm.

As indicated by directional arrows in FIG. 2, each brush 40 rotates in a direction opposite to that of an adjacent brush 40. As shown in FIG. 2, the direction of brushes 40*a* and 40*c* is counterclockwise and that of brushes 40*b* and 40*d* is clockwise. In this way, the angular torque created by each of the brushes during operation is substantially equalized.

While brushes 40*a–d* are rotating at a desired cleaning rate, boat 11 is slowly moved manually, or by some other means (e.g., a winch), in a reverse direction, starting from the stern and working forward to the bow. More than one pass of boat 11 over cleaning assembly 32 may be desirable if the hull has been neglected. Once the bottom of hull 12 has been cleaned, the pneumatic power supply is deactivated, and brushes 40*a–d* come to a halt. Winch 44 is then operated to lower cleaning assembly 32 to a hull clearing position, to allow the next boat to be maneuvered into position for cleaning.

It is recognized that, due to friction and suction caused by brushes 40*a–d* during rotation, brushes 40*a–d* will have a tendency to cling to hull 12 and travel with boat 11 as it is moved through the cleaning operation. To counter this tendency, the lengths of control lines 50*a–d* are held fixed by winch 44, causing brush assemblies 34*a–d* to be restrained from moving any substantial amount.

Figure 8:
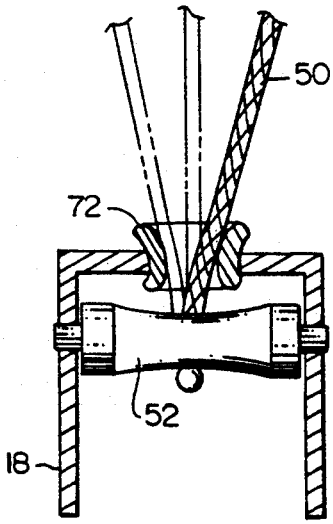
FIG. 8 is a sectional view of a bushing employed in combination with a pulley wheel in the support mechanism of the boat hull cleaning apparatus of the present invention.

As shown in FIG. 4, control lines 50*a–d* engage pulley wheels 52*a–d* respectively and pass through openings 70*a–d* respectively. During the cleaning operation, control lines 50*a–d* will have a tendency to slide back and forth across pulley wheels 52*a–d* and, sometimes, rub against the walls of openings 70*a–d*. This undesirable motion, and its deleterious effects on control lines 50*a–d*, can be substantially eliminated by installing a slightly flared bushing 72 (See FIG. 8) in each of openings 70*a–d*. Bushing 72 functions to constrain control lines 50*a–d* in their lateral motion across pulley wheels 52*a–d*, and reduces the friction caused by lines 52*a–d* rubbing against the walls of openings 70*a–d*.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

We claim:

1. An apparatus for cleaning a boat hull floating in a body of water, comprising:

means, fixed in position, for supporting said cleaning apparatus in said body of water;

a hull cleaning assembly including a brush assembly, said brush assembly having means for providing buoyancy to said brush assembly, a motor supported by said buoyancy means, and a cleaning brush coupled to a drive shaft of said motor;

means, connected to said hull cleaning assembly and associated with said supporting means, for moving said brush assembly between a hull cleaning position and a hull clearing position in the body of water, said moving means having means for controlling the position of said brush assembly, including causing said brush assembly to rise from said hull clearing position to said hull cleaning position as a result of said buoyancy means; and means, connected to the motor of said brush assembly, for conveying operating power to the motor.

2. An apparatus as recited in claim 1, wherein said hull cleaning assembly comprises a plurality of brush assemblies each having buoyancy means, a motor supported by said buoyancy means, and a cleaning brush coupled to a drive shaft of said motor;

said moving means being connected to each of said plurality of brush assemblies for moving said brush assemblies between respective hull cleaning positions and respective hull clearing positions;

said control means being configured for controlling the positions of said plurality of brush assemblies, including causing said brush assemblies to rise from said respective clearing positions to said respective cleaning positions as a result of said respective buoyancy means; and said power conveying means being connected to each of the motors of said plurality of brush assemblies for conveying operating power to the motors.

3. An apparatus as recited in claim 2, wherein said moving means includes a control line, movably engaging said supporting means, and connected to said cleaning assembly at one end and to said control means at the other end.

4. An apparatus as recited in claim 2, wherein said buoyancy means of each of said plurality of brush assemblies are hinged together to constitute a unified hull cleaning assembly.

5. An apparatus as recited in claim 4, wherein said moving means includes a plurality of control lines movably engaging said supporting means and each connected to one of said plurality of brush assemblies at one end and to said control means at the other end.

6. An apparatus as recited in claim 5, wherein said supporting means includes a support member; and pulley means, rotatably secured to said support member, for changing the direction and point of application of pulling forces generated by said control means and said brush assemblies across said plurality of control lines, said plurality of control lines movably engaging said support member through said pulley means.

7. An apparatus as recited in claim 6, wherein said buoyancy means of each respective brush comprises a shell having a wall that an interior volume and an opening, said wall containing an exterior recess with a hole therethrough in which the motor of said respective brush assembly is installed; and a plate, attached to said shell over the opening such that said shell is enclosed thereby, the drive shaft of the motor extending through said plate, and the motor being fixedly mounted to said plate.

8. An apparatus as recited in claim 7, wherein the interior volume of said shell contains a buoyancy material.

9. An apparatus as recited in claim 8, wherein said control means comprises a winch.

10. An apparatus as recited in claim 8, wherein the brush of each of said brush assemblies is a circular brush.

11. An apparatus as recited in claim 8, wherein the motor of each of said plurality of brush assemblies is an air motor; and wherein said power conveying means is an air supply line.

12. An apparatus as recited in claim 8, wherein the motor of each of said plurality of brush assemblies is a hydraulic motor; and wherein said power conveying means is a hydraulic fluid line.

13. An apparatus as recited in claim 8, wherein the motor of each of said plurality of brush assemblies is an electric motor; and wherein said power conveying means is an electric power cable.

14. An apparatus as recited in claim 8, wherein said buoyancy material is a polystyrene plastic.

15. An apparatus as recited in claim 10, wherein each circular brush of said cleaning assembly rotates in a direction opposite to that of an adjacent circular brush, such that the angular torque created by each of the brushes during operation is substantially equalized.

16. An apparatus for cleaning a boat hull floating in a body of water, comprising:

means, fixed in position, for supporting said cleaning apparatus in said body of water;

a hull cleaning assembly including a plurality of brush assemblies, each respective brush assembly having means for providing buoyancy to said brush assembly, a motor supported by said buoyancy means, and a cleaning brush coupled to a drive shaft of said motor, said buoyancy means of said plurality of brush assemblies being hinged together to form a unified hull cleaning assembly;

means, associated with said supporting means and connected to said plurality of brush assemblies, for moving said plurality of brush assemblies between respective hull cleaning positions and respective hull clearing positions, said moving means having means for controlling the position of said plurality of brush assemblies, including causing said brush assemblies to rise from said respective hull clearing positions to said respective hull cleaning positions as a result of said respective buoyancy means, and retaining said brush assemblies in said respective hull cleaning positions during the cleaning of said boat hull; and means, connected to each of the motors of said plurality of brush assemblies, for conveying operating power to the motors.

17. An apparatus as recited in claim 16, wherein said moving means includes a plurality of control lines, movably engaging said supporting means, and each connected to one of said plurality of brush assemblies at one end and to said control means at the other end.

18. A method of cleaning a boat hull floating in a body of water, comprising the steps of supporting said cleaning apparatus in said body of water using a supporting means fixed in positioned, said cleaning apparatus having a plurality of brush assemblies;

maneuvering the boat hull in the body of water over said brush assemblies, each of said brush assemblies having a buoyancy element, a motor supported by said buoyancy element, and a cleaning brush coupled to a drive shaft of said motor;

controlling the position of said plurality of brush assemblies, including floating said brush assemblies under operation of a control system to a cleaning position around a bottom portion of the boat hull, by employing the respective buoyancy elements of said brush assemblies, such that said cleaning brushes are in contact with the boat hull; and actuating said cleaning brushes into a cleaning action by driving said motors.

19. A method as recited in claim 18, further comprising the steps of positioning one end of the boat hull directly over said cleaning brushes and, while said brushes are actuated into a cleaning action, moving the boat hull over said actuated cleaning brushes from said one end to another end of the boat hull.

20. A method as recited in claim 18, wherein the step of actuating said cleaning brushes includes rotating each respective cleaning brush in a direction opposite to that of an adjacent cleaning brush.

* * * * *

UNITED STATES PATENT AND TRADEMARK OFFICE

CERTIFICATE OF CORRECTION

PATENT NO. : 5,222,452

DATED : June 29, 1993

INVENTOR(S) : Michael J. Maloney and Ronald C. Pennock

It is certified that error appears in the above—identified patent and that said Letters Patent is hereby corrected as shown below:

Column 9, Claim 7, Line 53

"that an interior"

should read

--that defines an interior--

Signed and Sealed this

Twenty-second Day of March, 1994

Bruce Lehman

*Attest:*

BRUCE LEHMAN

*Attesting Officer*

*Commissioner of Patents and Trademarks*